United States Patent [19]

Katayama et al.

[11] 3,987,756

[45] Oct. 26, 1976

[54] DEVELOPING DEVICE

[75] Inventors: Hajime Katayama, Tokyo; Akiyoshi Torigai, Machida; Shigeyoshi Onoda, Kawasaki, all of Japan

[73] Assignee: Canon Kabushiki Kaisha, Tokyo, Japan

[22] Filed: Apr. 2, 1975

[21] Appl. No.: 564,299

[30] Foreign Application Priority Data

| | | |
|---|---|---|
| July 19, 1974 | Japan | 49-82979 |
| July 27, 1974 | Japan | 49-86381 |
| July 27, 1974 | Japan | 49-86383 |

[52] U.S. Cl. ..... 118/637; 355/4

[51] Int. Cl.[2] ..... G03G 15/08

[58] Field of Search ..... 118/637; 427/18; 355/4; 96/1.2

[56] References Cited

UNITED STATES PATENTS

| | | | |
|---|---|---|---|
| 3,663,100 | 5/1972 | Itoh et al. | 355/10 |
| 3,694,069 | 9/1972 | Yamaji et al. | 355/4 |
| 3,709,594 | 1/1973 | Hastwell | 355/4 |
| 3,795,917 | 3/1974 | Yamaji et al. | 355/4 |
| 3,801,197 | 4/1974 | Akiyama et al. | 355/4 |
| 3,838,919 | 10/1974 | Takahashi | 355/4 |
| 3,854,449 | 12/1974 | Davidson | 118/637 |

*Primary Examiner*—Mervin Stein
*Assistant Examiner*—Douglas Salser
*Attorney, Agent, or Firm*—Fitzpatrick, Cella, Harper & Scinto

[57] ABSTRACT

In a developing device for developing an electrostatic image on an image carrier member, a plurality of developing units for supplying predetermined color developers are supported by support means having a movable support member for revolvably supporting each of the developing units and for moving each of the developing units along a common circumference. The support means is driven by drive means. Orientation regulating means is connected to each of the developing units to maintain the same in a predetermined orientation.

12 Claims, 21 Drawing Figures

DEVELOPING DEVICE

BACKGROUND OF THE INVENTION

1. Field of the Invention

This invention relates to a developing device suited for polychromatic reproduction, and more particularly to a developing device which enables the surface of a photosensitive medium to be developed always under the same conditions as it passes by a developing station.

2. Description of the Prior Art

In a typical design heretofore devised for developing electrostatic images of various colors formed on a photosensitive medium by a color copying apparatus, units for applying various color developers to the photosensitive medium are prepared corresponding to the number of the colors and juxtaposed closely adjacent to each other and along the path of movement of the photosensitive medium. One of these developing units which corresponds to the electrostatic image of a predetermined color is driven when such electrostatic image passes by the developing station.

In such a design, the mixture of distinct developers has been liable to occur between the juxtaposed developing units, thus resulting in a color mixture of reproduced image. Firstly, in such arrangement, it is necessary that one developing unit be operated while all the other developing units remain completely inoperative. Moreover, for example, in case of magnetic brush development wherein a magnetic brush is rotated to apply toner for development, the probability of toner scattering is so high that scattered toner is very likely to enter the adjacent inoperative developing units. This must be obviated by providing a suction duct for each of the developing units.

Thus, in the developing device of the described type, a very complex mechanism is required for the prevention of color mixture and the group of developing units occupies such a great space around the photosensitive medium as to limit the space for other process means.

Further, the juxtaposed relationship of the developing units gives rise to a difference in distance with respect to the location of the latent image forming means, especially, the exposure station, which would affect the conditions of development and accordingly the reproduced image.

Also, if the above-described developing device is applied with a drum-shaped photosensitive medium, the configurations of the developing units must be varied depending on the location of the developing device, and this leads to a disadvantage that the same standard or specification could not commonly be applied in the manufacture of the developing units.

In view of these points, the present invention provides a developing device which will achieve the following objects.

SUMMARY OF THE INVENTION

It is an object of the present invention to provide a developing device which enables good color reproduction without the risk of color mixture.

It is another object of the present invention to provide a developing device which enables distinct color developments under the same conditions.

It is still another object of the present invention to provide a developing device which is satisfactorily operable even at high-speed.

Generally describing the present invention, developing units for supplying predetermined color developers are disposed circumferentially of a rotatable member and in a predetermined spaced-apart relationship, and in accordance with the color to be reproduced on the member to be developed, a predetermined one of the developing units is circularly moved to the developing station where the member to be developed is located.

Other objects and features of the present invention will become fully apparent from the following detailed description of some specific embodiments taken in conjunction with the accompanying drawings.

BRIEF DESCRIPTION OF THE DRAWINGS

FIG. 14-A is a cross-sectional view showing another embodiment of the distance setting mechanism.

DESCRIPTION OF THE PREFERRED EMBODIMENTS

Figure 1:
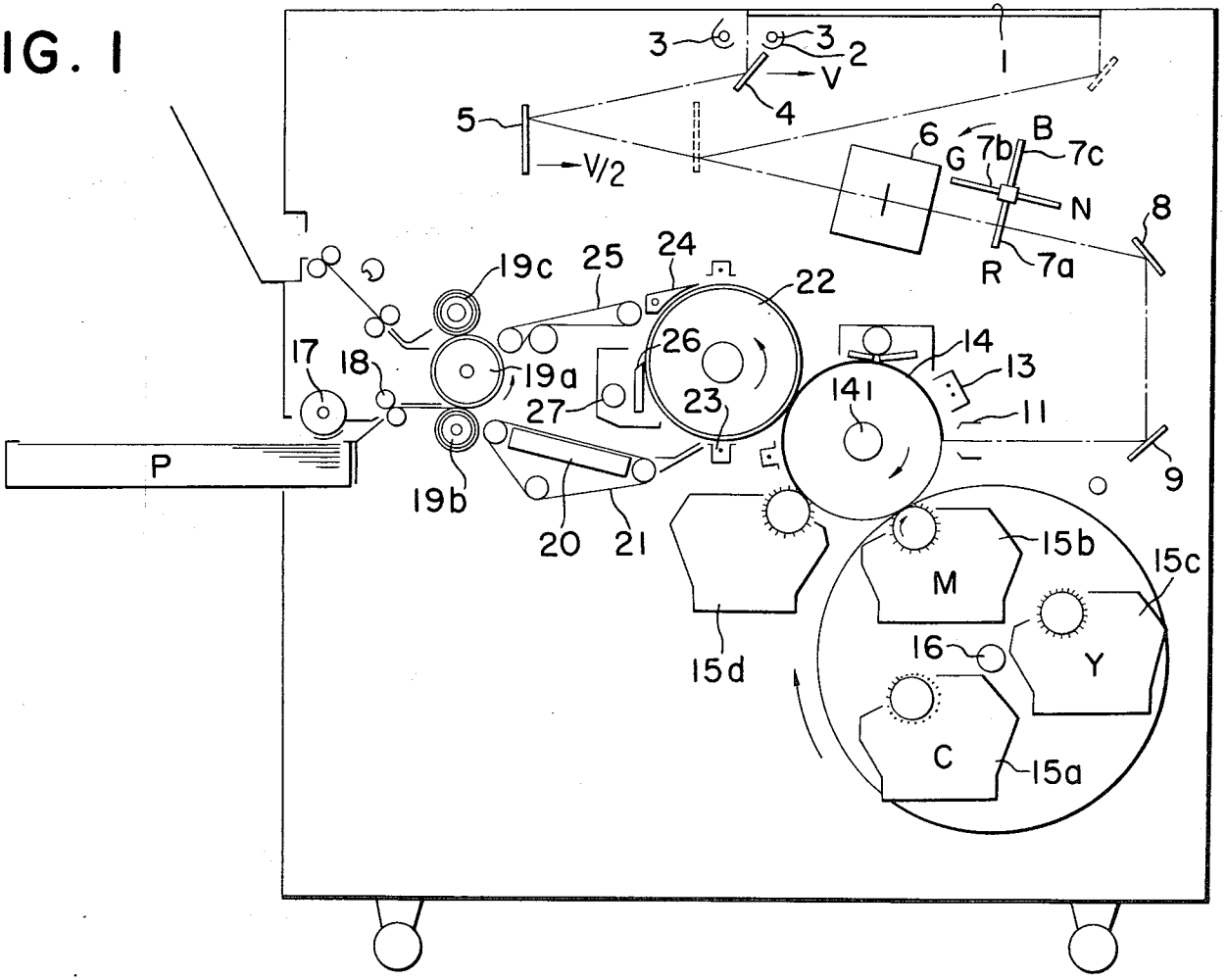
FIG. 1 is a side view illustrating a specific example of the copying apparatus to which is applied the developing device according to the present invention.

Operation of an electronic copyping apparatus using the developing device according to the present invention will first be described by reference to FIG. 1. An original on an original carriage glass 1 is illuminated by an illuminating system (iodine lamps 3 and reflectors 2) and the reflected light therefrom is scanned by a first scanning mirror 4 and a second scanning mirror 5. In scanning the original, the first and second mirrors are moved at a velocity ratio of 1 : ½ to thereby maintain the first half of the optical path of a lens system 6 constant at all times. The reflected image light is passed through the lens 6 to color-resolving filter means 7, whereby the image light is color-resolved by one of filters 7*a*, 7*b* and 7*c* corresponding to three colors—red (R), green (G) and blue (B). The image light so color-resolved is directed via stationary third and fourth mirrors 8 and 9 and passed through a dust-proof sealing glass 11 so as to be focused on a photosensitive drum 14. The photosensitive drum 14 is rotatably supported on a shaft $14_1$ and rotatable in the direction of arrow upon depression of a copy button. As it is rotated, the photosensitive drum is first charged (with positive polarity, for example) by a primary charger 13, whereafter it is deelectrified by an AC deelectrifier while being exposed to the color-resolved image light, and it is further illuminated uniformly throughout the entire surface thereof by an allover exposure lamp 54, whereby an electrostatic latent image of high contrast is provided on the drum surface.

The electrostatic latent image on the photosensitive drum 14 is then developed into a visible image by a developing device 15. The developing device comprises four developing units 15*a*, 15*b*, 15*c* and 15*d* for cyan (C), magenta (M), yellow (Y) and black-and-white (B&W). A developing unit corresponding to the operated color-resolving filter (for example, the yellow developing unit 15*c* for the blue filter) is rotated to its developing position to effect development.

In FIG. 1, three units used for color copying, i.e. 15*a* for cyan toner, 15*b* for magenta toner and 15*c* for yellow toner, form a group of developing units, and the black toner developing unit 15*d* for black-and-white copying is arranged independently.

Figure 2:
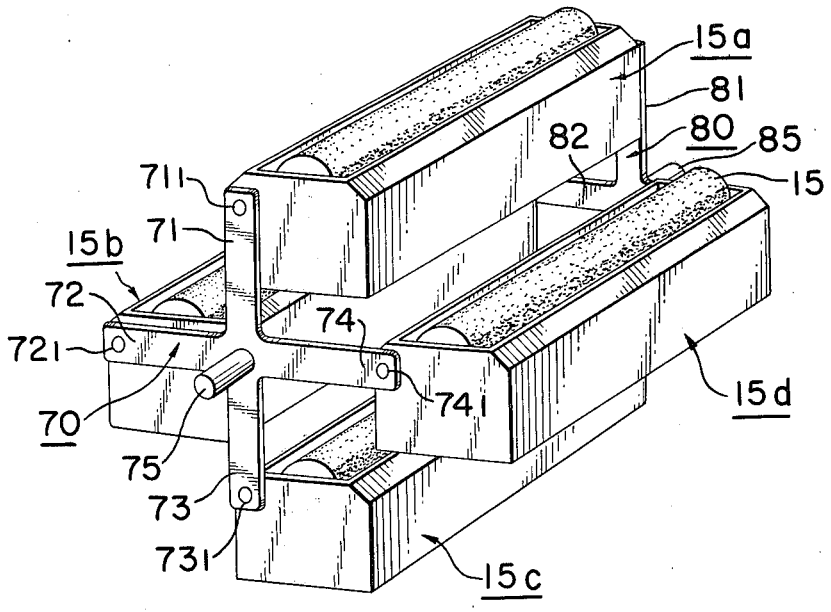
FIG. 2 is a perspective view illustrating another embodiment of the developing device according to the present invention.

It will be apparent that this is not the only possible arrangement but, for example, the four developing units 15 may be arranged for rotation about a shaft 16, as shown in FIG. 2. Such latter arrangement, however, might greatly affect the operational function of the copying apparatus and would require much caution.

From within a cassette, a sheet of transfer paper P is fed into the apparatus by a pickup roll 17 and synchronized with the image on the drum by a timing roll 18 as it is passed to a drying roll arrangement 19. The drying roll arrangement 19 comprises three rolls, namely, a center roll 19*a*, a lower roll 19*b* and an upper roll 19*c*, each of which accommodates therein a heater. The lower roll is formed of a metal roll covered with a thin layer of silicone rubber, the center roll is formed of metal with a covering is formed of metal, and the upper roll formed of heat-resistant rubber (silicone rubber or the like). The transfer paper P is pressed and heated by and between the rolls 19*a* and 19*b* to cause evaporation of the moisture in the transfer paper and increase the resistance value of the paper, and is further conveyed by a conveyor belt 21 rotating on a suction device 20 to reach a transfer roll 22, where the transfer paper is electrostatically attracted by a corona discharger 23 at the back thereof. Thereafter, the transfer paper P is brought into contact with the toner image on the photosensitive drum 14 so that the toner is transferred onto the transfer paper. In case of color copying, the same transfer paper is moved round three times to permit three color-resolved images to be superposed upon one another to provide a colored image, whereafter a separator pawl 24 is operated to separate the transfer paper from the transfer roll 22, and thence the transfer paper is conveyed by a conveyor belt 25 to a pair of fixing rolls 19*a* and 19*c* whereby the paper is pressed and heated to fix the toner image, and finally discharged.

After all the toner images of respective colors have been transferred, the surface of the photosensitive drum 14 is cleaned by a cleaning device comprising a resilient blade, and the drum enters a next cycle.

As in the above-described embodiment of the apparatus, by providing different operative positions for the developing unit effecting monochromatic, especially black, reproduction and for the developing units effecting polychromatic reproduction, i.e. cyan, magenta and yellow units, it is possible to easily accomplish changeover between monochromatic reproduction and polychromatic reproduction. In offices or the like, it is usually the case that a few copies are to be produced of each of various originals such as typewirtten documents, polychromatic images, etc. and therefore, the construction of the above-described copying apparatus is excellent in that selection and setting of a predetermined developing unit for monochromatic reproduction can be done very quickly and waiting time is reduced.

The developing device of the present invention applied to the foregoing copying apparatus is designed such that each opening for development always faces upwardly. Thus, the risk of falling developer and other undesirable possibilities may all be eliminated.

Figure 3:
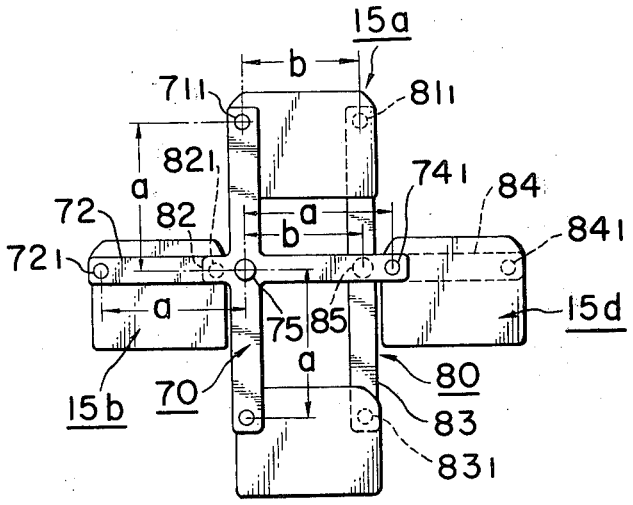
FIG. 3 is a side view illustrating a mechanism for moving the developing units of the developing device with their orientations maintained constant.
Figure 4A:
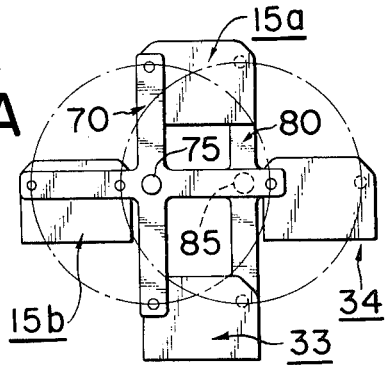
FIG. 4 illustrates the operation of the mechanism shown in FIG. 3.

FIG. 3 shows a specific example of the mechanism for causing such opening of each developing unit to face upwardly at all times. FIGS. 4A, B and C illustrate the manner of movement thereof. The developing units 15*a*–15*d* are disposed parallel to each other between arms 71 and 81, 72 and 82, 73 and 83, 74 and 84 of a pair of left and right cross-shaped, rotatable side plates 70 and 80 and mounted to these arms by means of support shafts $71_1$–$74_1$ and $81_1$–$84_1$. Numerals 75 and 85 designate the rotary shafts of the side plates 70 and 80, respectively. The length of the side plates 70, 80 and the length of each arm (the length from the rotary shaft to the support shaft) are all equal, being *a*. The side plates 70 and 80 are disposed with the axes of their rotary shafts 75 and 85 being offset by a distance *b* with respect to each other, and the distance between the axis of the support shaft of each developing unit which is attached to the side plate 70 and the axis of the support shaft of each developing unit which is attached to the side plate 80 is set to *B*.

In other words, there is constructed a parallel movement mechanism of parallelogramic configuration with two opposed sides (each being of length *a*) provided by the support arms of the left and right side plates 70 and 80 with respect to each developing unit 15*a*–15*d* and with two opposed sides (each being of length *b*) provided by the distance between the rotary shafts 75 and 85 of the left and right side plates 70 and 80 and the distance between the support shafts on the opposite side plates. Thus, when the shaft 75 and/or the shaft 85 is driven to rotate the opposite side plates 70 and 80 in the same direction and at the same speed, all the developing units 15*a*–15*d* will be revolved around a circumference about a mid-point M passing through the shafts 75 and 85 while they keep their openings facing upwardly at all times.

The developing device of the above-described construction is installed below the photosensitive medium. After exposure to a first color light is completed and when the photosensitive medium 14 with an electrostatic latent image formed thereon has come round to the developing station, the developing unit 15*a* corresponding to that color is brought to the developing position prior to or in synchronism with the photsensitive medium (the position of FIG. 4A) and a magnetic brush in that developing unit is rotated to develop the electrostatic latent image on the photosensitive drum 14 into a visible image.

Figure 4C:
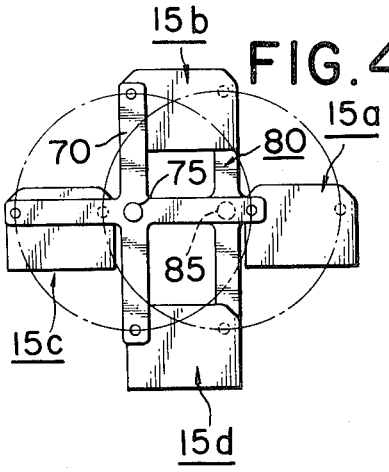
Figure 4B:
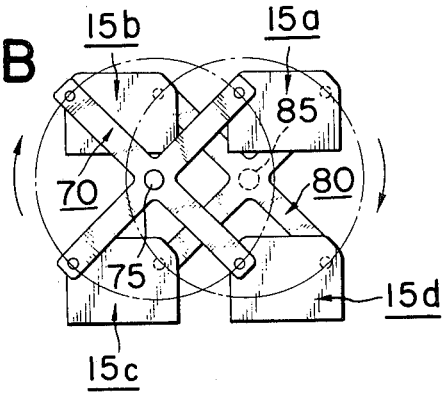

Next, after the development corresponding to the first color light is completed and when exposure to a second color light is to be effected, the entire developing device is rotated through a predetermined angle (shown as being 90°), whereby the units rotate through a position as shown in FIG. 4B to enter the position shown in FIG. 4C, wherein the developing unit 15*a* has been moved away from the developing position and the developing unit 15*b* corresponding to the second color light is set to the developing position. After exposure to the second color light is completed and when the photosensitive medium with a second electrostatic latent image comes round to the developing station, a magnetic brush in the developing unit 15*b* is rotated to effect development. Such process is thereafter repeated to accomplish polychromatic development.

Figure 5:
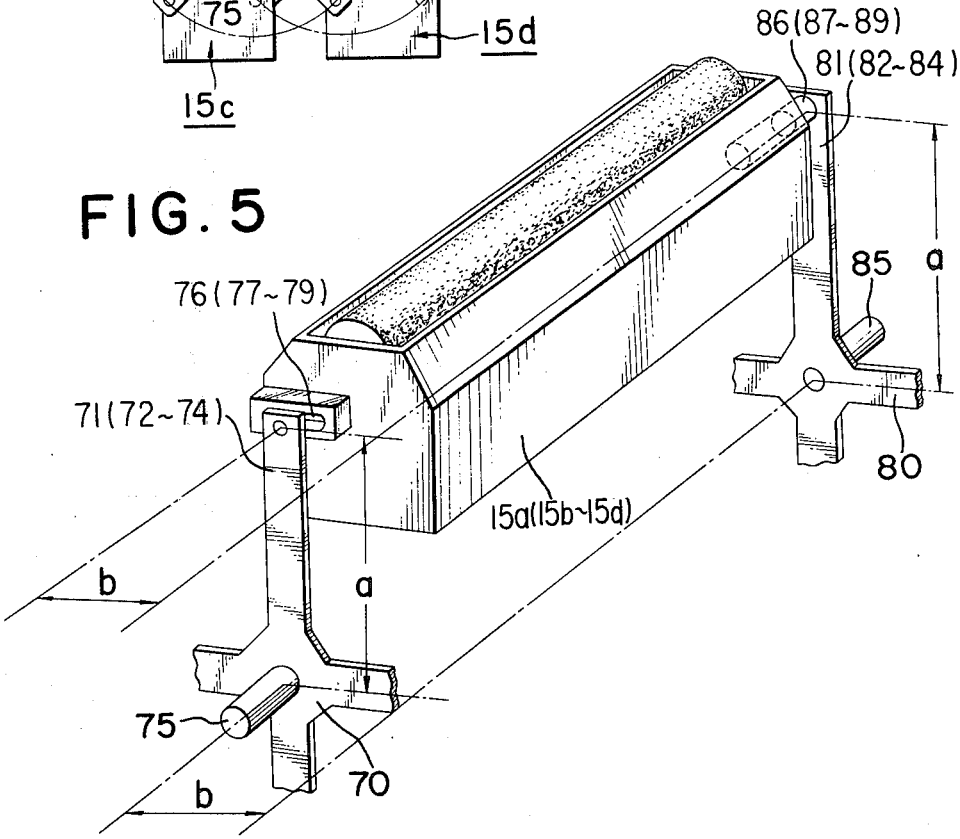
FIG. 5 is a perspective view showing an example of the turning mechanism having a movement allowance.

In the developing device constructed as described above, the projection distance *b* between each support shaft on the side plate 70 supporting each developing unit and each support shaft on the side plate 80 must be highly accurately equal to the distance *b* between the rotary shafts 75 and 85 of the opposite side plates 70 and 80. For this reason, as shown in FIG. 5, one supporting portion 86 (87–89) for each side plate is rotatably supported with respect to each developing unit and the other supporting portion 76 (77–79) is supported with some freedom of horizontal movement (as by means of slot or the like), whereby assembly may be done with high accuracy which will also result in good operability.

Figure 6:
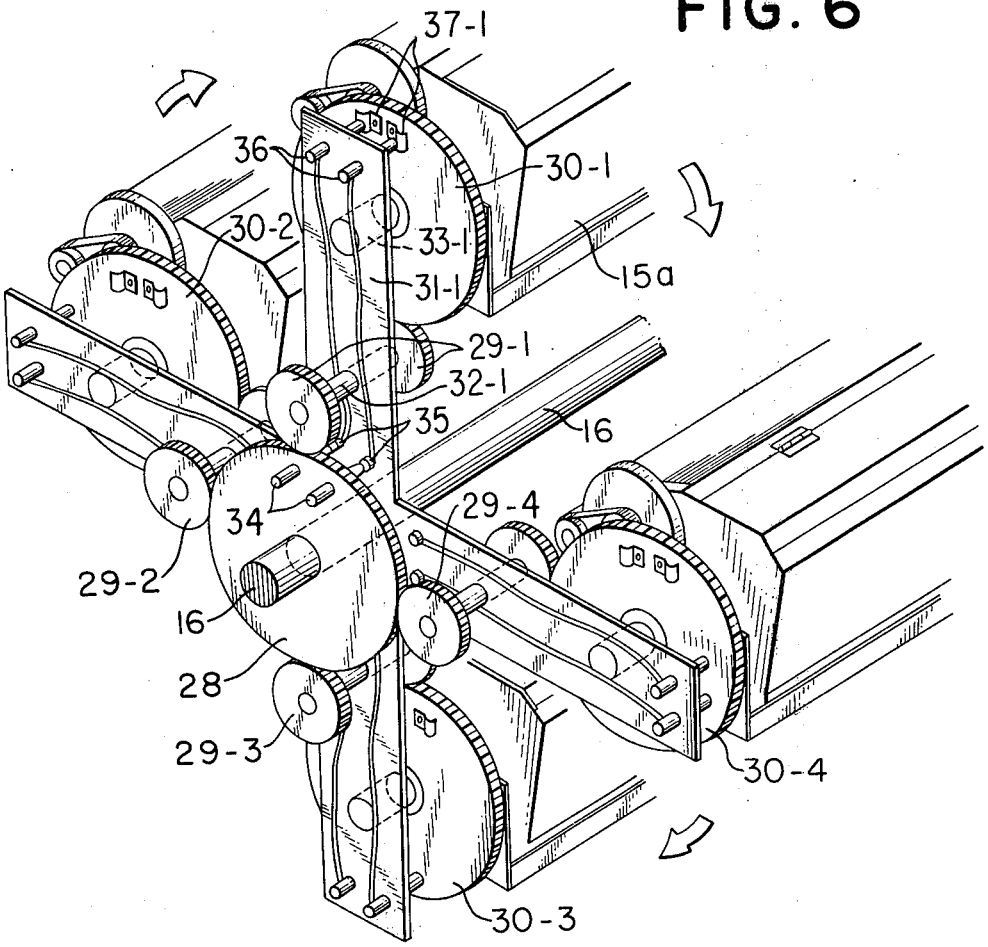
FIG. 6 is a perspective view illustrating another example of the mechanism which can achieve the same effect as the mechanism of FIG. 5.

FIG. 6 is a perspective view showing another form of the mechanism which can achieve the same object as the mechanism of the above-described construction.

A center shaft 16 about which a group of developing units are revolved is secured to the center shaft or to a side plate, a first planetary gear 29-1 meshing with the sun gear 28, a second planetary gear 30-1 disposed outwardly of and meshing with the first planetary gear 29-1, and a planetary arm 31-1 connecting together the shafts of those three gears. This gearing arrangement regulates the orientation of each developing unit.

The planetary arm 31-1 is supported for rotation with respect to the center shaft 16, and a first planetary gear shaft 32-1 and a second planetary gear shaft 33-1 are supported for rotation with respect to the planetary arm 31-1. The number of teeth of the sun gear 28 and that of the second planetary gear 30-1 must be equal to each other, whereas the number of teeth and the shaft position of the first planetary gear 29-1 must of course be determined so that the space between adjacent ones of the rotating developing units is minimized. Each individual developing unit is securely supported by respective one of the second planetary gears 30-1 (30-2, 30-3, 30-4), but the above-described planetary gearing mechanism may advantageously be provided on each of the axially opposite sides of the developing device in order to reliably support these developing units and provide for smooth movement thereof.

With such construction, the group of developing units may be moved with their developing openings facing upwardly.

In this regard the group of developing units must be revolved maintaining their horizontal positions at all times, but the three-gear train and the tolerances may cause tilt or twist of the developing units. To prevent this, the support of the developing units with respect to the second planetary gear may preferably be adjustable.

Also, as in the previously described construction, arranging the center shafts of the opposite support arms in offset relationship will provide horizontal stability.

Figure 7:
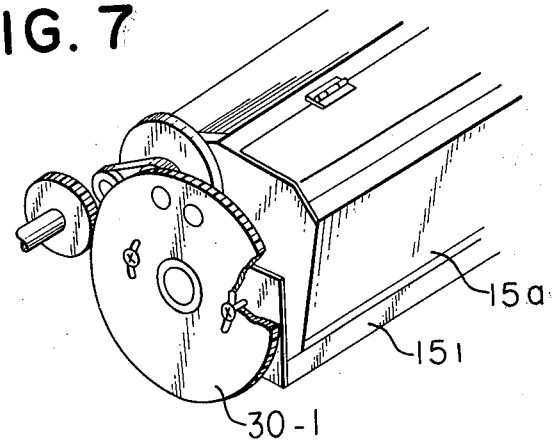
FIG. 7 is a fragmentary perspective view particularly showing a developing unit.

In an example shown in the fragmentary view of FIG. 7, a bed $\mathbf{15_1}$ for removably mounting thereon each developing unit 15 is provided and is secured to the second planetary gear 30-1. Holes for receiving their clamping screws are provided in the form of arcuate slots to ensure adjustability.

Description will now be made of an arrangement for ensuring good electrical connection between each developing unit and the main body of the apparatus when a circuit is provided for detecting and controlling the density of the developer in each developing unit.

As shown in FIG. 6, connecting brushes or slip rings 34, 35-1 (35-2, 35-3, 35-4), 36-1 (36-2, 36-3, 36-4), 37-1 (37-2, 37-3, 37-4) are provided on the planetary arms, the planetary gears 30 and the sun gear 28, and the circuit in each developing unit is arranged to be connected with an external circuit only in the developing position. In the shown example, the connecting brushes on one of the planetary gears may be positively contacted by resilient contact members such as plate springs 37-1 (37-2, 37-3, 37-4).

In the developing device as described above, each developing unit to be changed over for each developing operation has a considerable weight and, accordingly, a considerable inertia force during movement thereof. Therefore, if the developing units are driven directly by a motor or the like, they will most probably create a sudden action at the start and stop of their movement, and this will impart a great shock to the developing device which would cause toner to scatter.

Further, the load to the drive motor is so great as to reduce the service life of the apparatus.

Figure 8:
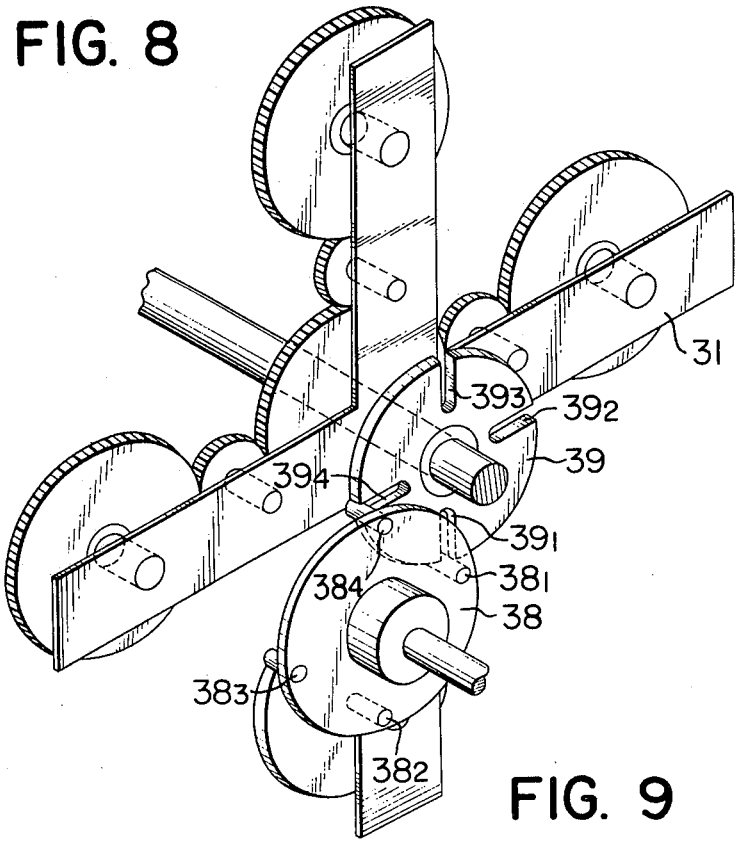
FIG. 8 is a perspective view of a further example of the turning mechanism.

FIG. 8 shows, in perspective view, a specific example of the mechanism which overcomes the problems resulting from the inertia force of the developing units and which enables gradual acceleration and deceleration during the start and stop periods. In the shown example, there are employed modified Geneva wheels utilizing the meshing engagement between four rollers and four radial grooves, which correspond in number to the developing units.

A geneva drive wheel 38 attached to drive means such a motor or the like (not shown) has four rollers $\mathbf{38_1}$, $\mathbf{38_2}$, $\mathbf{38_3}$ and $\mathbf{38_4}$ secured thereto and equally spaced on a common circumference. On a Geneva driven wheel 39, there are formed four radially extending grooves $\mathbf{39_1}$, $\mathbf{39_2}$, $\mathbf{39_3}$ and $\mathbf{39_4}$ engageable by the four rollers and set for smooth engagement by the rollers on each drive wheel. At the moment a roller on the drive wheel 38 is engaged and disengaged with a groove in the driven wheel 39, the segment passing from the center of the drive wheel shaft to the center of the roller is at right angles with the center line of the groove. By setting such positions as starting point and stop point, respectively, rotation will begin from the point of zero angular velocity at the beginning of engagement, thus ensuring smooth start. Smoothness will likewise by ensured at the termination of the engagement. Such movement characteristic of this mechanism is graphically illustrated in FIG. 9.

The Geneva driven wheel 39 is secured to each planetary arm 31 of the previously described planetary gearing arrangement so as to effect $n/4$ rotation of the drive wheel ($n$ is an integer) until a desired developing unit comes to the developing position, and to stop the drive wheel upon arrival thereof at a predetermined position. In this manner, the driving units may be intermittently turned with smooth motion. Such movement control may be utilized for development by causing a control circuit including a position detector and a developing unit selector means to control the intermittent movement to thereby bring any desired developing unit to the developing position.

Figure 10:
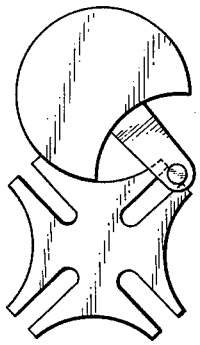
FIG. 10 shows a Geneva wheel used in the mechanism.

On the other hand, in a case where the arrangement of the developing units is definite and development is effected only in accordance therewith, namely, where four developing units are used in accordance with the arrangement thereof to effect development, the device may be steadily intermittently turned for ¼ of 360°. In such case, the intended purpose may be sufficiently achieved by the use of a conventionally used Geneva wheel (FIG. 10) having a single roller and a plurality of radial grooves.

More specifically, a roller on the drive wheel is engaged with a groove in the driven wheel to turn the unit group, and in the position where the roller has been disengaged from the groove, the unit group is stopped and a predetermined unit effects development. Thus, development occurs from the time when the roller has been disengaged till the time when the roller is engaged with the next groove. The period of time during which the unit group is moved and that during which it is stopped are determined by the rotation velocity of the roller and the number of grooves in the driven wheel.

When the developing unit group is moved, and especially stopped, by the above-described intermittent moving mechanism, there is a possibility that the unit group may overrun without overcoming its inertia force. It will therefore be necessary to provide a decelerating mechanism for negating such inertia force if the developing units are heavy in weight.

Figure 9:
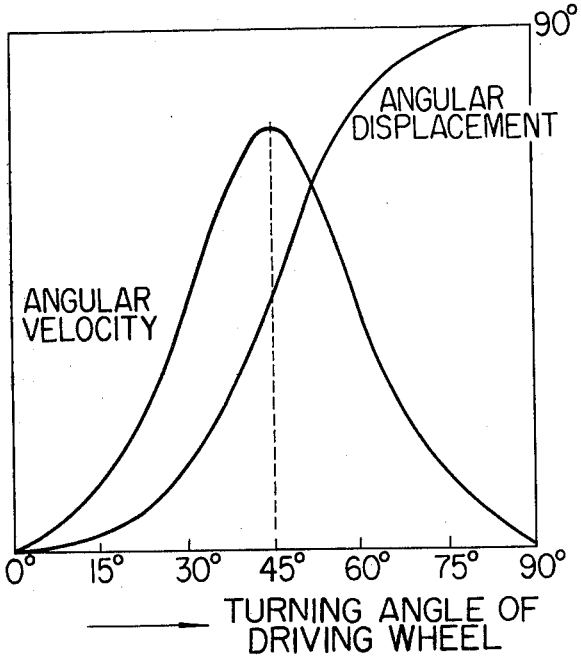
FIG. 9 is a graph illustrating the movement characteristic of the mechanism shown in FIG. 8.
Figure 11:
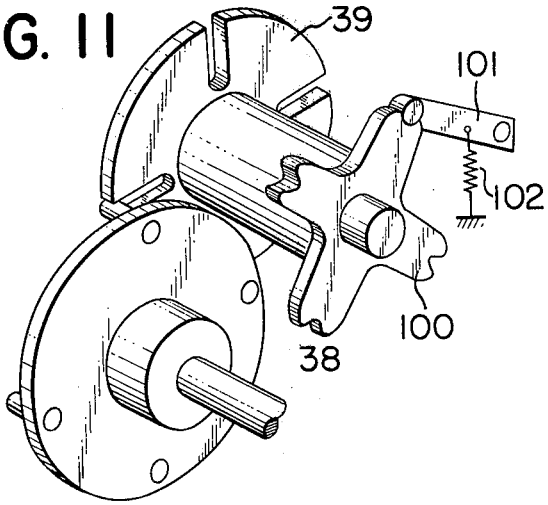
FIG. 11 is a perspective view showing an example of the decelerating mechanism.

FIG. 11 shows an example of the decelerating mechanism, which is adapted for attachment to the modified Geneva driven wheel shown in FIG. 8. It basically comprises a cam 100 secured to the driven wheel, and a cam follower 101 spring-biased by a spring 102 or the like for rotation in the direction opposite to the direction of rotation of the driven wheel. Since the cam follower 101 begins to block the rotation of the cam 100 at a point whereat the driven wheel attains its maximum angular velocity during rotation, a force in the direction opposite to the direction of rotation of the driven wheel is imparted to the driven wheel and this force increases with the progress of rotation. In this manner, the inertia force of the developing units is negated to prevent overrun and the developing units may be controlled to the movement characteristic as shown in FIG. 9.

The above-described mechanism is not the only possible means but, of course, a friction brake mechanism or the like is equally applicable.

Figure 12:
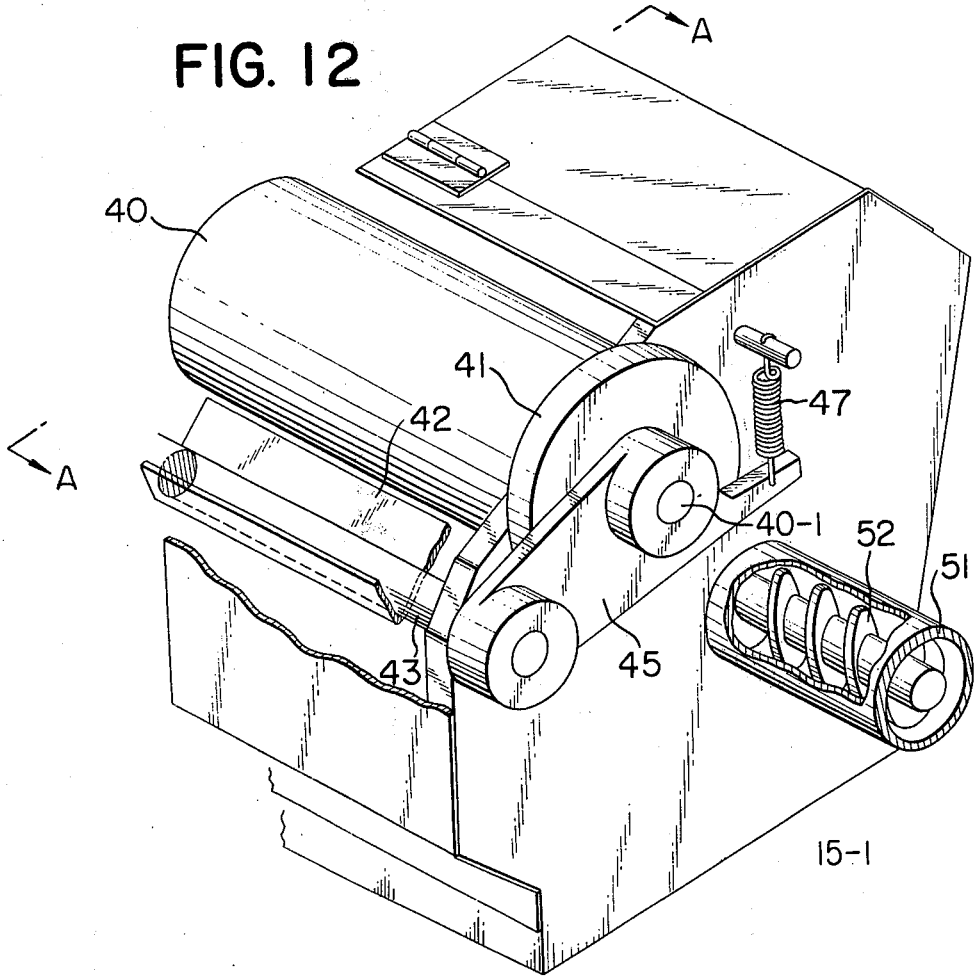
FIG. 12 is a perspective view showing an example of the distance setting mechanism for maintaining a predetermined distance between a developing surface and a surface to be developed.

On the other hand, it is preferable in practice that the distance between the developer surface of the magnetic brush in each developing unit moving to the developing position for the photosensitive medium and the surface of the photosensitive medium be maintained constant. An example of such distance setting mechanism is shown in FIG. 12.

As shown, a developing roller 40 such as a magnet roller for supplying developer to the surface of the photosensitive medium or a sleeve for rotating a non-magnetic cylinder about a magnet roller is mounted for floating with respect to side plate 15-1 of the developing device 15. A support arm 45 has one end thereof mounted on a shaft 43 for pivotal movement with respect to the side plate 15-1. The other end of the support arm is engaged with a spring 47 depending from a pin studded in the side plate, so that the support arm is pivotable. A support shaft 46 for said roller or sleeve is retained on the support arm 45, whereby the developing roller 40 is floatably held with respect to the body of the developing unit 15.

Thus, the distance between the surfaces of the developing roller 40 and the photosensitive medium may readily be set to an optimum value.

The optimum distance for development between the photosensitive medium and the developing roller may be empirically determined. Let such distance be $l$. Also, let the outer diameter of the developing roller 40 be D. Then, by mounting a disc-like (or cylindrical) roller 41 of diameter $D+2l$ concentrically with the developing roller 40, an optimum condition for development may be maintained at all times. In such cases, the roller 41 may most suitably be designed to make contact with the non-image-bearing portion of the photosensitive medium or the peripheral portion of the photosensitive drum at the end thereof. Thus, each of the developing units may be set to an optimum condition when it is brought to the developing position.

Figure 13:
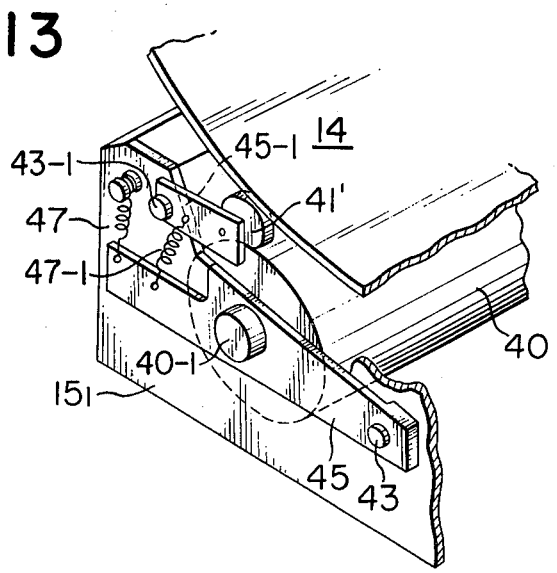
FIG. 13 shows another example of the distance setting mechanism.

FIG. 13 shows a different embodiment in which the distance setting roller is provided between the developing roller and the photosensitive medium. A positioning roller 41' is retained on a separate support arm 45-1 for free rotation with respect to the developing roller 40 floatably mounted as already described, and the positioning roller 41' is disposed intermediately of the photosensitive medium 14 and the developing roller 40 and journalled to side plate 15-1 of the developing unit by means of a shaft 43-1. The support arm 45-1 is retained to the support arm 45 of the developing roller 40 by means of a spring 47-1, so that the positioning roller 41' maintains its contact with the developing roller 40 at all times. On the other hand, the developing roller 40 is biased toward the surface of the photosensitive medium by the spring 47, so that the developing roller 40 is always maintained at a predetermined distance with respect to the photosensitive medium, with the positioning roller intervening therebetween.

The above-described positioning roller may be formed of any material having a low coefficient of friction, such as, for example, Delrin (tradename) or the like.

Figure 14:
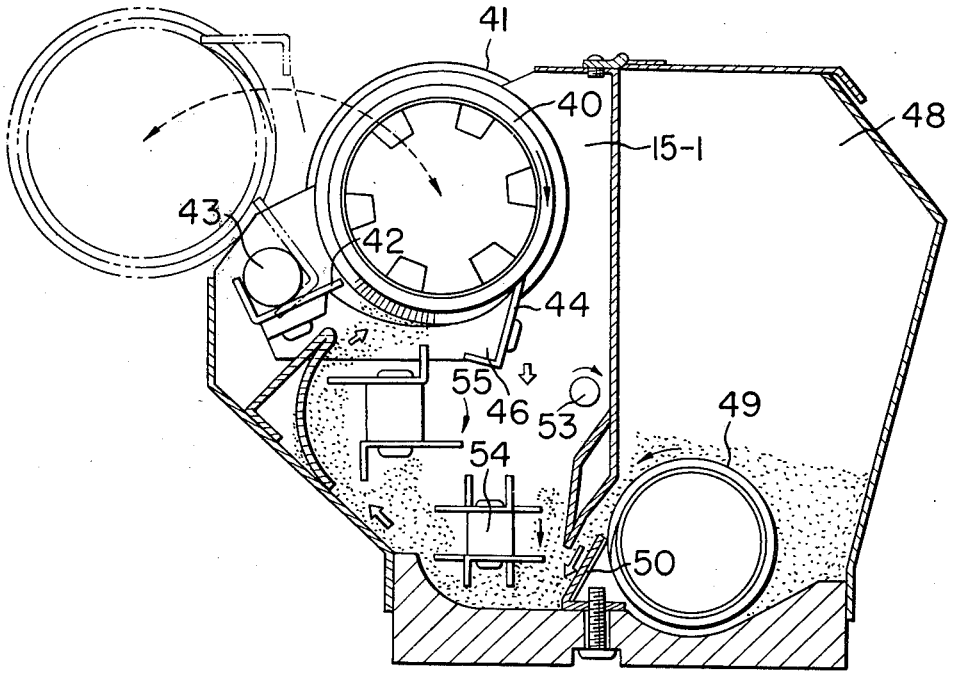
FIG. 14 is a cross-sectional view taken along line A—A in FIG. 12.
Figure 14A:
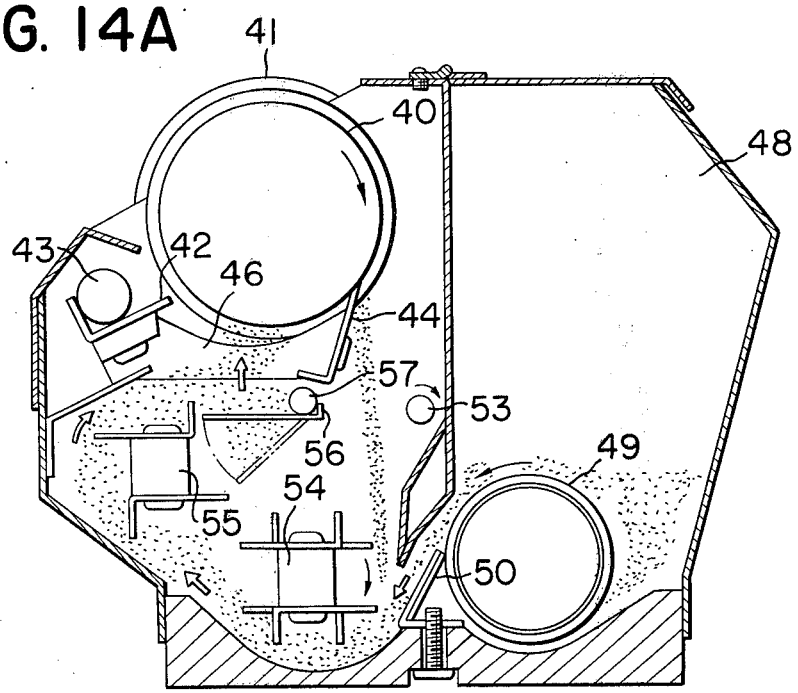

FIG. 14 is a cross-sectional view of the FIG. 12 device taken along line A–A. As shown, around the developing roller 40, there is provided a doctor blade 42 of non-magnetic material for adjusting the height of toner, for example, on a roller which controls the supply amount of developer, or a scraper 44 or the like for removing any toner which may remain on the roller 40 after development.

These mechanisms must maintain a strict distance with respect to the developing roller 40 and thus, must be mounted for rotation with this roller. In the shown example, the doctor blade 42 is secured to the shaft 43 while the support arm 45 and the shaft 43 are securely connected together, so that the doctor blade 42 is always maintained at a predetermined position with respect to the developing roller 40.

Further, the mechanism such as scraper 44 or the like is retained on an arm 46 securely mounted on the shaft 43 to maintain a predetermined positional relationship.

As indicated by phantom lines in FIG. 14, the developing roller 40 is movable about the shaft 43 to the outside of the device and this increases the convenience for maintenance. Such movement of the developing unit will now be explained. In FIG. 14, numeral 48 designates a developer containing portion in which the developer is fed toward the developing roller portion by a feed roller 49 and completely stirred by stirring impellers 54, 55, and then the developer is supplied to the developing roller 40, whereafter it is removed from the surface of the roller 40 by the scraper 44. The removed unnecessary developer is discharged through a discharge port 51 by a screw 52 mounted on a rotation shaft 53.

In the meantime, the amount of toner in the developing unit is decreased with repetition of the developing operation. Such decreasing density of toner must be compensated for by supply of fresh toner, but the case where each developing unit must be displaced for each developing operation as in the developing device of the present invention, the supply of extra toner is difficult and will have to be effected by the use of a complicated mechanism.

Figure 15:
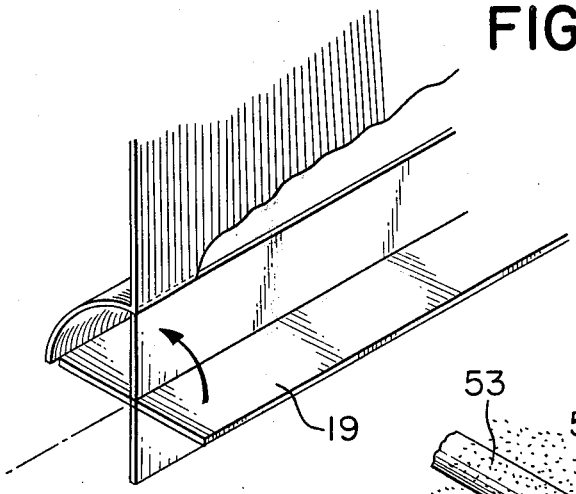
FIG. 15 is a fragmentary perspective view showing an impeller for feeding the developer.

In view of this, in the embodiment of the developing unit according to the present invention, as shown in FIG. 14, the interior of the developing unit is partitioned to provide a developer containing portion 48 in which a mechanism for feeding the developer is installed. The developer feeding mechanism, if the developer contains a carrier, may preferably be a magnetic brush 49 of the sleeve rotation and internal stationary magnet type which is parallel to the developing sleeve and of a width at least equal to the width of the image. On the other hand, if the developer contains no magnetic carrier, use may be made of a feeding mechanism which does not resort to magnetic force but adopts, for example, an impeller 49' (FIG. 15) having a number of plates secured to a shaft longitudinally thereof.

Since these feeding mechanisms have a sleeve or an impeller having a width corresponding to the width of the image, an advantage results in that the time required for the supplied toner to affect the image is shorter and that a great amount of toner can be supplied even if the turning angle is small.

In the case where a sleeve is used for feeding of the developer, the toner in the developer sticks to the sleeve with the carrier and at a point whereat the sleeve is rotated away from the magnetic pole, the toner falls into the developing unit. A scraper 50 may be disposed in contact with the sleeve to ensure further reliable feeding of the developer.

The operation of the toner feeding mechanism is controlled by an electrical signal from an automatic density detector provided within the developing unit. Thus, as the means for transmitting rotation to the rotary sleeve of the mechanism, use may be made of an electromagnetic clutch in such a manner that, when the electrical signal has arrived, an electromagnet in the clutch is energized to transmit the drive from a motor to the sleeve to rotate the latter. It will be apparent that other suitable means such as a spring clutch or the like is equally usable.

The toner fed into the developing unit by the toner feeding mechanism moves in the direction as indicated by hollow arrow in FIG. 14 and sticks to the developing sleeve 40 for use in development.

After having passed the developing zone, the toner remaining on the sleeve 40 is scraped off by a scraper 44 in contact with the sleeve, and then mixed with fresh supply of toner for reuse.

Figure 17:
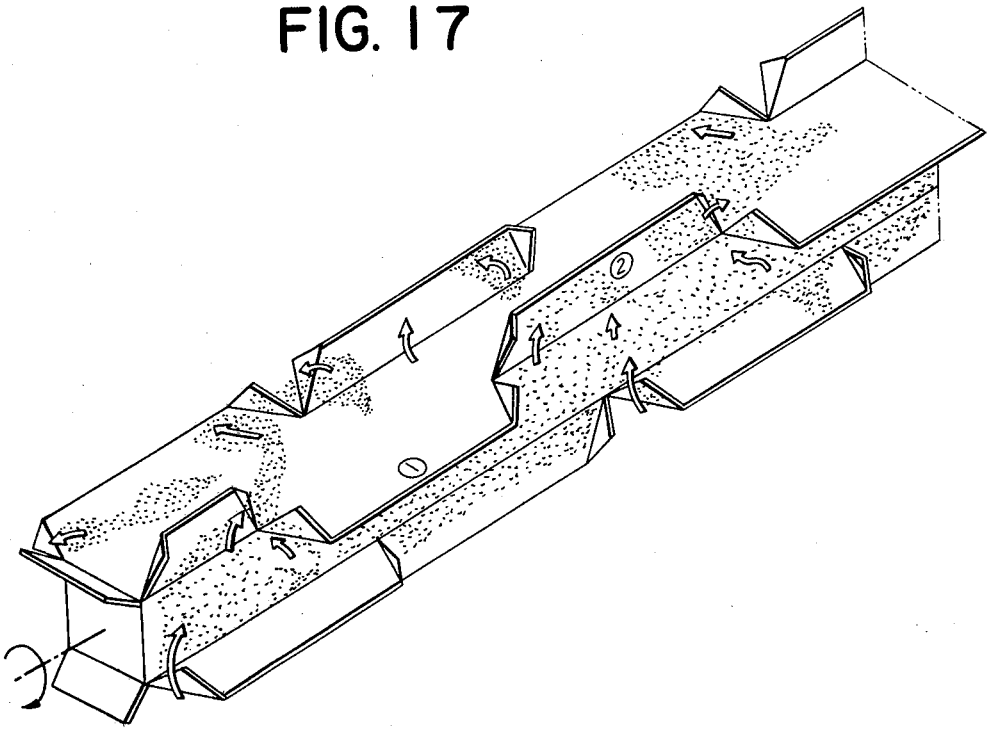
FIG. 17 is a perspective view showing a first stirrer for a developer unit.

The first stirrer 54 acts chiefly to mix toner and carrier uniformly and the second stirrer 55 acts to raise the developer stirred by the first stirrer up to the developing sleeve 40. FIG. 17 illustrates the first stirrer 54 which comprises a square rod and flat plates bent as shown and secured to the upper and lower sides of the square rod. Part of the developer is forced by the stirring plate ① to flow along the opposite bent ear portions and toward the opposite sides, and part of the developer moves to the stirring plate ②. The stirring plates ① and ② are at right angles with each other, so that part of the developer which has come to the front of the plate ② is further forced by this plate to flow rightwardly as indicated by the arrow. Thus, with rotation of the stirring plates, there occurs movement of the developer in the lengthwise direction of the stirrer so that the toner and the carrier may be mixed together uniformly.

Figure 18:
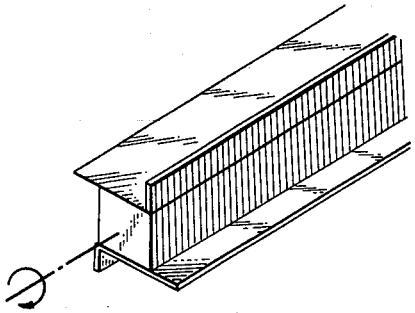
FIG. 18 is a fragmentary perspective view showing a second stirrer.

FIG. 18 shows the configuration of the second stirrer.

The developer blended by the first stirrer 54 is scooped up by the stirring plates of the second stirrer 55 and magnetically attracted to the sleeve 40. If the second stirrer 55 should be disposed at a location spaced from the sleeve 40, a guide plate 56 may suitably be disposed as shown in FIG. 14-A.

By doing so, the stirrer is rotated and a stirring plate thereof strikes the guide plate 56 to force the same downwardly while the toner on the stirring plate rides onto the guide plate with rotation of the stirring plate. The stirring plate is further rotated and when it leaves the guide plate, the guide plate is rotated about the shaft 57 by the force of a spring (not shown) to restore its original position. At this moment, the toner may be raised above the guide plate to reach the range of the magnetic force of the sleeve. The guide plate repeats the above-described swinging movement with rotation of the stirrer and may be replaced, for example, by a fixed plate spring secured to the shaft 57.

On the other hand, the developer containing carrier, when used for a long period of time, will have the carrier surface covered with toner and become unable to provide images of good quality. To prevent such deterioration of the developer, it will be necessary to suitably supply carrier. At the same time, the carrier is used again and again and will become excessive relative to toner, and thus it will also become necessary to remove such excess carrier.

Figure 16:
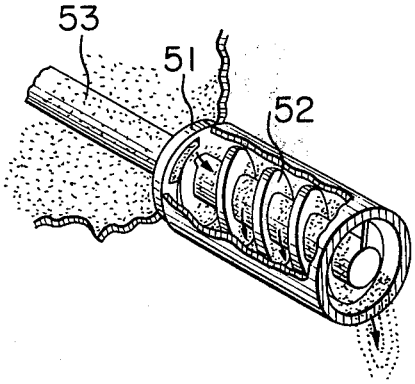
FIG. 16 is a fragmentary perspective view showing a discharge portion of the developing unit.

In the device of the present invention, as shown in FIGS. 12 and 16, excess developer may be discharged by a screw 52 through an opening 51 formed in the side plate 15-1 of the developing unit 15.

Moreover, as a result of the shaft portion 33 of the second planetary gear of the developing device being made hollow so as to match the opening 51 and the screw being designed to operate only during the operation of the developing units, all developing units will effect overflowing action at the same position and thus, only one recovery container will be required, thereby reducing the required space within the device.

According to the device of the present invention, as has specifically been described, developing conditions are identical so that good color reproduction can be provided without the risk of color mixture. In addition, the driving mechanism is controlled satisfactorily and this enables very good operation of the machine even during high-speed reproduction and accordingly, facilitates high-speed reproduction. Furthermore, a good supply of developer is also ensured within each developing unit to thereby maintain good quality of reproduced images, resulting in very high effectiveness in practical use.

We claim:

1. A developing device for developing an electrostatic image on an image carrier member, comprising:

a plurality of developing units for supplying predetermined color developers;

support means having a movable support member for revolvably supporting each of said developing units and for moving each of said developing units along a common circumference;

drive means for imparting a drive to said support means;

velocity control means for transmitting the drive of said drive means to said support means so as to gradually accelerate said movable support member of said support means from a rest position and gradually decelerate said movable support member to reach a next rest position; and orientation regulating means connected to each of said developing units to maintain the same in a predetermined orientation.

2. A developing device according to claim 1, wherein said velocity control transmission means includes a driving plate rotatable by a drive force transmitted thereto from said drive means, said drive plate having a predetermined number of rollers provided thereon, and a driven plate connected to drive said support means and having a plurality of grooves for receiving said rollers wherein said driven plate is rotated by said driving plate.

3. A developing device according to claim 1, further comprising means connected to said support means for determining the rest positions for each of said developing units.

4. A developing device according to claim 3, wherein said rest position determining means includes a braking mechanism for said support means.

5. A developing device for developing an electrostatic image on an image carrier member, comprising:

a plurality of developing units revolvably supported;

support means having a support member supported for rotation on a center shaft to support said developing units;

orientation regulating means having a sun gear facing said support member and mounted concentrically with said center shaft, first planetary gears corresponding in number to said units and meshing with said sun gear and rotatably supported on said support member, and second planetary gears corresponding in number to said first planetary gears and meshing therewith, each of said second planetary gears and each of said developing means being retained together;

drive means for imparting a drive to said support means; and velocity control transmission means for transmitting the drive of said drive means to said support means so as to gradually accelerate said support means from a rest position and gradually decelerate said support means to reach a next rest position.

6. A developing device according to claim 5, wherein said velocity control transmission means includes a driving plate rotatable by a drive force transmitted thereto from said drive means, said drive plate having a predetermined number of rollers provided thereon, and a driven plate connected to drive said support means and having a plurality of grooves for receiving said rollers wherein said driven plate is rotated by said driving plate.

7. A developing device for developing an electrostatic image on an image carrier member, comprising:

a plurality of developing units revolvably supported from the opposite sides thereof;

means for supporting said developing units in a regulated orientation, said support means including two rotary shafts having the axes thereof disposed parallel to each other and a pair of support members attached perpendicularly to said rotary shafts for supporting said developing units at the opposite sides thereof; and drive means for rotatably moving said support means.

8. A developing device according to claim 7, further comprising a plurality of first planetary gears and second planetary gears provided on one said support member, a sun gear mounted concentrically with the rotary shaft attached to said one support member, and orientation regulating means coupled to said developing units and said second planetary gears for maintaining said developing units in a predetermined orientation.

9. A developing device according to claim 7, further comprising means connected to said support means for determining the rest positions for each of said developing units.

10. A developing device according to claim 7, further comprising velocity control means for transmitting the drive of said drive means to said support means so as to gradually accelerate said moveable support member of said support means from a rest position and gradually decelerate said movable support member to reach a next rest position.

11. A developing device according to claim 10, wherein said velocity control transmission means includes a driving plate rotatable by a drive force transmitted thereto from said drive means, said drive plate having a predetermined number of rollers provided thereon, and a driven plate connected to drive said support means and having a plurality of grooves for receiving said rollers, wherein said driven plate is rotated by said driving plate.

12. A developing device according to claim 10, wherein said rest position determining means includes a braking mechanism for said support means.

* * * * *

UNITED STATES PATENT AND TRADEMARK OFFICE

CERTIFICATE OF CORRECTION

PATENT NO. : 3,987,756

DATED : OCTOBER 26, 1976

INVENTOR(S) : HAJIME KATAYAMA, AKIYOSHI TORIGAI, SHIGEYOSHI ONADA

It is certified that error appears in the above-identified patent and that said Letters Patent are hereby corrected as shown below:

Column 3, line 52, delete in its entirety and insert --metal, and the upper roll is formed of metal with a covering--;

line 53, delete "roll".

Column 6, line 57, after "such" insert --as--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*